United States Patent [19]

Whitaker

[11] Patent Number: 4,585,069

[45] Date of Patent: Apr. 29, 1986

[54] LIQUID DISCHARGE NOZZLE

[75] Inventor: George N. Whitaker, East Providence, R.I.

[73] Assignee: Grinnell Fire Protection Systems Company, Inc., Cranston, R.I.

[21] Appl. No.: 662,447

[22] Filed: Oct. 18, 1984

[51] Int. Cl.[4] ..... A62C 37/08; B05B 1/26

[52] U.S. Cl. ..... 169/37; 169/40; 239/498; 239/499; 239/504; 239/524

[58] Field of Search ..... 169/37, 41, 42, 38, 169/40; 239/498, 499, 504, 524, DIG. 1

[56] References Cited

U.S. PATENT DOCUMENTS

| | | | |
|---|---|---|---|
| 459,449 | 9/1891 | Smith | 169/37 |
| 2,135,138 | 5/1937 | Kendall | 239/500 |
| 4,279,309 | 7/1981 | Fischer et al. | 169/37 |

*Primary Examiner*—Andres Kashnikow
*Assistant Examiner*—Patrick N. Burkhart
*Attorney, Agent, or Firm*—Salter & Michaelson

[57] ABSTRACT

A liquid discharge nozzle that is operative for discharging liquid in a relatively narrow, elongated spray pattern. The nozzle includes a deflector having an elongated central apex portion of preferably arcuate configuration and a pair of side portions diverging from opposite side edges of the apex portion and having tines formed along the terminal edges thereof; and a frame for mounting the deflector adjacent a liquid discharge outlet so that when liquid is discharged from the outlet, at least a portion of the liquid impinges on the inner surface of the central portion of the deflector and is deflected outwardly along the inner surfaces of the deflector. Preferably, a substantially centrally disposed inwardly projecting boss of generally elliptical configuration is formed in the central apex portion of the deflector and a deflector mounting boss is formed on the frame adjacent the deflector boss. The two bosses are preferably disposed centrally in the flow path of liquid discharged from the outlet so that they cooperate for initially redirecting the liquid outwardly along the inner surfaces of the deflector to assure that sufficient quantities of liquid are disbursed throughout the central portion of the elongated spray pattern. The combination of the tines and slots located along the longitudinal side edges of the deflector helps spread the flow of liquid uniformly throughout the regions adjacent to the longitudinal peripheries of the relatively narrow spray pattern.

12 Claims, 5 Drawing Figures

LIQUID DISCHARGE NOZZLE

BACKGROUND AND SUMMARY OF THE INVENTION

The instant invention relates to liquid discharge systems and more particularly to a nozzle for discharging a liquid, such as a fire-retardent fluid, throughout a relatively narrow, elongated spray pattern.

Generally, the heretofore available discharge nozzles for use in fire-protection sprinkler systems have fallen into two main categories: closed nozzles with heat sensitive elements which are individually responsive to abnormally high-temperature conditions and open nozzles which only discharge liquid when an automatic control valve has been operated by an independent firedetection device. A variety of different liquid spray nozzles are included in these two general categories and have been heretofore available to meet the needs of various commercial and/or residential applications. Most of the heretofore-known liquid discharge nozzles have been operative for producing substantially circular liquid discharge patterns, and it has been found that nozzles of this type are satisfactory for many applications. These nozzles have been mainly used in fire protection systems of the type which comprise a plurality of nozzles which are disposed in a predetermined array so that the peripheral portions of the spray patterns of adjacent nozzles overlap slightly when liquid is discharged from them. Systems of this type have been effective for most fire-protection applications, although they have been somewhat inefficient in certain applications where the configurations of their spray patterns don't match the configurations of the areas to be protected.

A particular problem is presented when it is necessary to provide a fire-protection system for distributing liquid relatively uniformly throughout an elongated, relatively narrow coverage area. This problem is encountered in a number of industrial fire-protection system applications, such as open-nozzle systems for protecting relatively slender objects, such as long coal conveyors, long cylindrical petrochemical tanks, petroleum tank cars, electrical cable trays, and structural beams. Generally, several types of liquid discharge nozzles have been used for applications of this type, although they have not been highly efficient. For example, one scheme of sprinkler system which has been used for protecting relatively long slender objects comprises a plurality of conventional nozzles of the type which discharge liquid over a relatively short distance in either a conical or an umbrella shaped pattern, and which are positioned in generally aligned spaced relation. In order to produce a spray pattern which can provide adequate coverage for an elongated, relatively narrow area, the adjacent spray nozzles of a system of this type are directed generally perpendicular with respect to the designated coverage area and they must be positioned in relatively closely spaced relation so that the spray patterns thereof overlap to produce the desired combined spray pattern. A fire-protection system of this type requires a substantially greater than normal quantity of nozzles in order to produce the desired density of fire-retardent fluid coverage over the designated area for adequate fire protection. Hence, a greater than normal amount of piping is required for a system of this type, and much of the piping must be oversized to accommodate water flow rates which are higher than normal in order to assure that adequate quantities of liquid will be discharged. A second scheme which has been used for protecting relatively long slender objects comprises a plurality of conical spray nozzles of the type which discharge liquid over a relatively long distance and which are positioned in spaced, generally aligned relation, but which are directed generally longitudinally with respect to the desired coverage area. Systems of this type have also required substantial spray pattern overlapping in order to provide the desired coverage, so that they also have required greater than normal quantities of nozzles per unit area, and hence the piping for these systems has also required larger than normal pipe sizes. In both the first and second schemes described above, the source of the fire retardent fluid must also have a greater than normal flow capacity.

The problem of providing an effective fire protection system for a generally rectangular area has been addressed by the inventions disclosed in the U.S. patents to LEWIS U.S. Pat. Nos. 868,459; MOWRY 1,288,123; TYDEN 2,101,694; KENDALL 2,135,138; and VORKAPICH 3,880,239, these patents representing the closest prior art to the instant invention of which the applicant is aware. These references teach a variety of different discharge nozzle constructions which are intended to produce various different noncircular spray patterns. However, they do not teach a discharge nozzle which provides an effective, substantially uniform liquid spray pattern for covering a relatively narrow, elongated area. They also do not teach a spray nozzle having the specific structural features of the spray nozzle of the instant invention, and hence for these reasons references are believed to be of only general interest.

The instant invention provides a novel spray nozzle which effectively provides an elongated, relatively narrow spray pattern which is substantially uniform over its entire area of coverage. The nozzle of the instant invention comprises a deflector having an elongated central portion and a pair of side portions which diverge angularly from the opposite side edges of the central portion and which each have a plurality of tines formed in the terminal portions thereof, and a frame for mounting the deflector adjacent a liquid discharge outlet so that when liquid is discharged from the outlet it impinges on the inner surface of the deflector in the central portion thereof and it is deflected outwardly along the inner surfaces of the side portions of the deflector. Preferably the deflector is of a generally V-shaped configuration with a curved central or apex portion, and the deflector and the frame are positioned so that when liquid is discharged from a discharge outlet, it impinges on the deflector in the area thereof where the deflector is attached to the frame. Further, in the preferred embodiment, a generally elliptically shaped boss is provided on the inner side of the deflector in the area thereof where the deflector is attached to the frame. A boss is also provided on the frame at the point where deflector is interconnected thereto. The two bosses are configured so that they cooperate, with the deflector boss being the more important, to at least partially redirect liquid from the discharge outlet so that the liquid passes generally outwardly in all directions from the axis of the liquid discharge and along the inner surfaces of the deflector. In addition, in the preferred embodiment of the nozzle, the tines which are located along the terminal portions of the side portions of the deflector are defined by slots which extend generally inwardly and towards the point where the deflector is attached to the frame so that they are generally aligned with the natural flow of liquid on the inner side of the deflector, and the tines in the central portions of the longitudinal peripheries of the deflector are bent inwardly slightly.

It has been found that as a result of the novel structural features of the spray nozzle of the instant invention it is operative for providing a relatively uniform distribution of liquid over an elongated, relatively narrow area. The boss on the inner side of the deflector and the mounting boss formed as part of the upper portion of the mounting frame cooperate to at least partially redirect liquid from the discharge outlet so that when it passes along the inner surfaces of the deflector a relatively uniform distribution liquid is achieved through the central portion of the elongated spray pattern. The combination of the slots and tines located along the longitudinal side edges of the deflector helps to spread the flow uniformly throughout the regions adjacent to the longitudinal peripheries of the relatively narrow spray pattern and the included angle between the side portions generally defines the central width of the spray pattern. The combination of the tines and the slots tends to break up the flow of liquid as it passes along the inner surfaces of the deflector so that it is randomly and relatively uniformly distributed throughout the regions adjacent to the longitudinal peripheries of the spray pattern. Further, the slots which define the tines are positioned so that they extend generally outwardly relative to the bosses in the central portion of the nozzle and as a result they are generally aligned with the natural flow of liquid as it moves outwardly on the inner surfaces of the deflector. Accordingly, all of these structural features cooperate to provide a nozzle which discharges liquid in an elongated, relatively narrow spray pattern and which provides a relatively uniform distribution of liquid throughout its coverage area.

It is, therefore, a primary object of the instant invention to provide an effective liquid spray nozzle for producing an elongated, relatively narrow, substantially uniform spray pattern.

Another object of the instant invention is to provide a spray nozzle which can be effectively used in fire-protection systems for relatively long slender objects.

Another object of the instant invention is to reduce the installation cost of fire-protection systems for relatively long, slender objects by discharging almost all of the available liquid over the designated coverage area.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
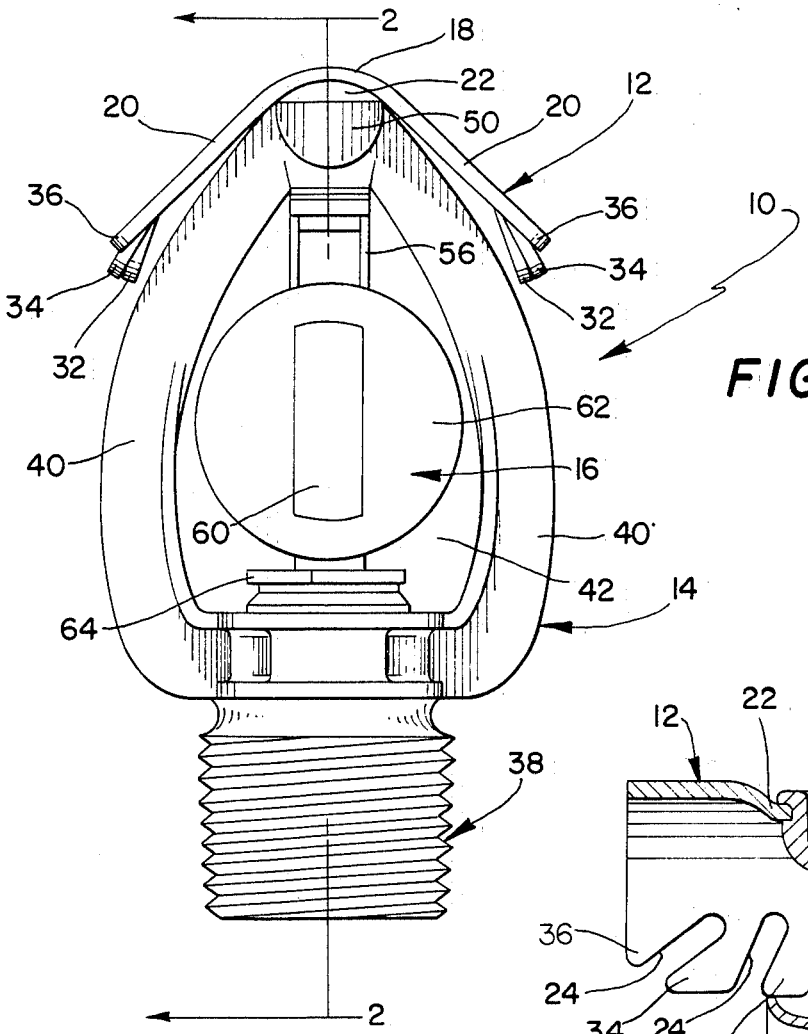
FIG. 1 is an enlarged end elevational view of the nozzle of the instant invention with a fusing assembly installed therein.

Referring now to the drawings, the liquid discharge nozzle of the instant invention is illustrated in FIGS. 1 through 5 and generally indicated at 10. The nozzle 10 comprises a deflector generally indicated at 12 which is of a generally V-shaped configuration with a curved apex portion, and a frame generally indicated at 14 for mounting the deflector 12 opposite a liquid discharge outlet so that liquid which is discharged from the outlet impinges on the inner side of the deflector 12 proximal the apex thereof. Accordingly, the deflector 12 is operative for redirecting the liquid outwardly so that a relatively narrow, elongated, substantially uniform spray pattern is discharged from the nozzle 10. The nozzle 10 is herein illustrated in combination with a fusible heat sensitive element assembly 16 which is responsive to a predetermined temperature condition for releasing liquid from a discharge outlet so that it impinges on the inner side of the deflector 12, although it will be understood that the use of the nozzle 10 as an open nozzle without a heat sensitive element is also contemplated.

The deflector 12 is preferably constructed from a suitable corrosion-resistant metal, such as brass, in a generally V-shaped configuration and it comprises an elongated, generally curved central or apex portion 18 having a substantially central axis 19 which defines an apex of the deflector 12, and a pair of side portions 20 which diverge from opposite sides of the central portion, i.e. they extend generally angularly outwardly therefrom. A substantially elliptically shaped deflector boss 22 is formed in the central area of the apex portion 18 and projects from the inner surface of the deflector 12 toward the frame 14, the deflector boss 22 being oriented so that the major axis of the elliptical configuration thereof is generally coextensive with the axis 19. A plurality of inwardly extending slots 24 is provided along each of the terminal portions of the side portions 20 for defining a plurality of tines along each of said terminal portions. The slots 24 extend generally inwardly toward the central portion of the apex portion 18, i.e., generally toward the boss 22, and they are preferably of substantially rounded configuration at the inner extremities thereof. The deflector 12 as herein embodied is formed with five slots 24 along each of the terminal edges of the side portions 20 thereof, and as a result six tines, which are indicated at 26, 28, 30, 32, 34 and 36, are formed along the terminal portions of each of the side portions 20 of the deflector 12. It will be understood, however, that other embodiments of the nozzle of the instant invention which include greater or lesser quantities of slots 24 and tines are contemplated. However, preferably, as in the deflector 12, the slots 24 cooperate to form tines which are symmetrically oriented and configured on the respective side peripheries of the deflector 12. More specifically, in the deflector 12 the tines 30 and 32 are symmetrically configured and oriented with respect to each other in the central portions of the side edges thereof, the tines 28 and 34 are symmetrically configured and oriented with respect to each other in outwardly spaced relation from the tines 30 and 32, and the tines 26 and 36 are symmetrically configured and positioned with respect to each other at the longitudinally opposite ends of the deflector 12. Preferably also the terminal ends of the tines 28, 30, 32 and 34 are substantially straight, as illustrated most clearly in FIG. 2, and the opposite ends of the deflector 12 are also preferably substantially straight. Further, in the preferred embodiment, the tines 28 and 34 are bent inwardly slightly with respect to the tines 26 and 36 which are generally coplanar with respect to the side portions 20, and the tines 30 and 32 are also preferably bent inwardly but to a slightly greater extent than the tines 28 and 34.

Figure 2:
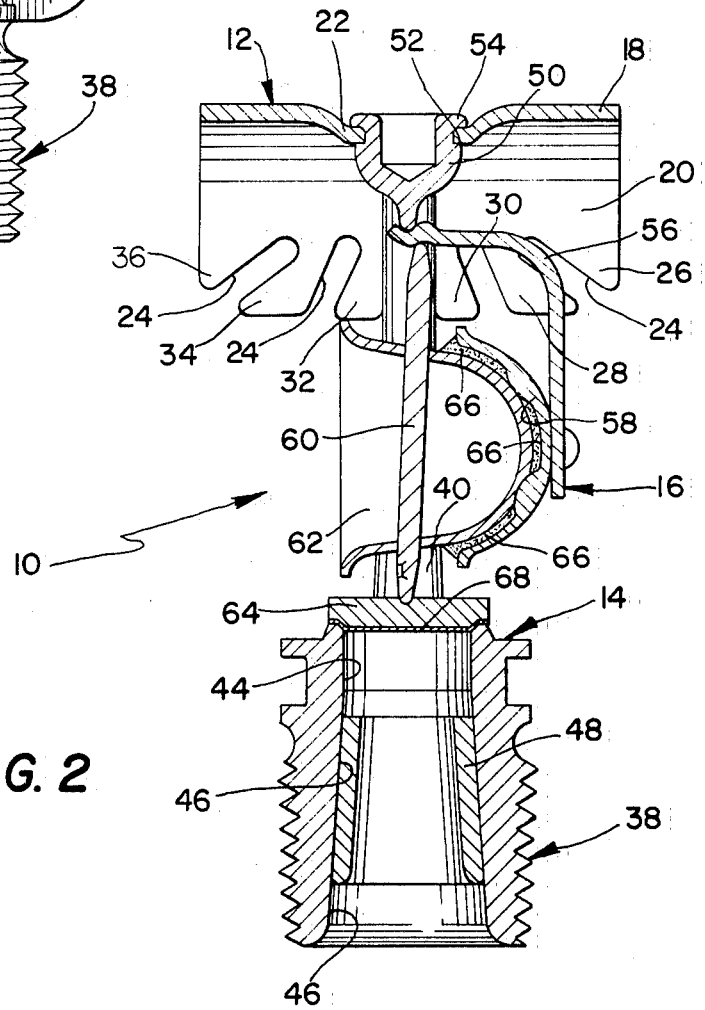
FIG. 2 is a side sectional view taken along line 2—2 in FIG. 1.
Figure 3:
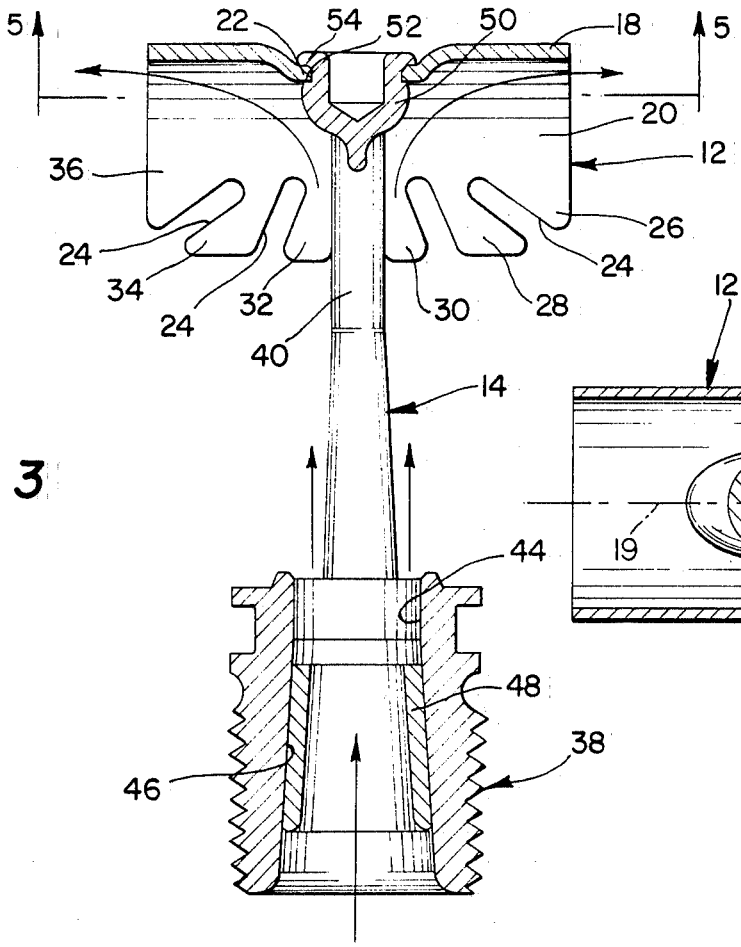
FIG. 3 is a similar sectional view of the nozzle per se.
Figure 5:
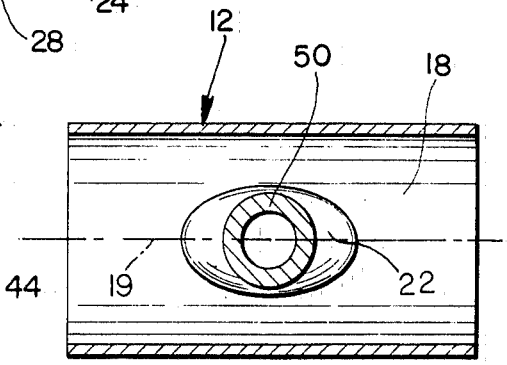
FIG. 5 is a sectional view taken along line 5—5 in FIG. 3.
Figure 4:
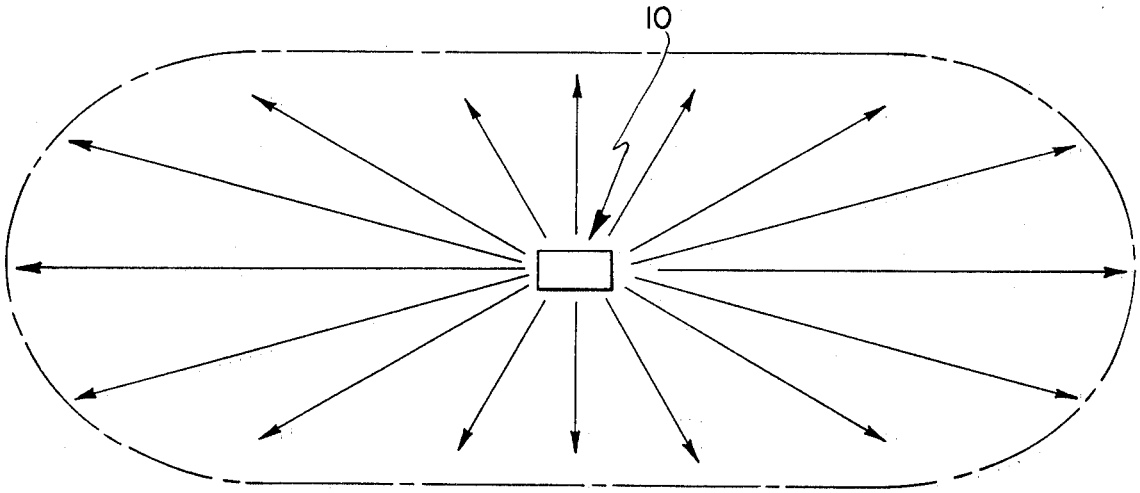
FIG. 4 is a schematic top plan view of the nozzle illustrating the liquid spray pattern produced therefrom.

The frame 14 comprises a threaded base portion generally indicated at 38 and a pair of arms 40 extend from opposite sides of the base portion 38 and converge at a point which is spaced from the base portion 38 so that the arms 40 cooperate to define an arch-like structure having an open interior area 42. The arms 40 are preferably formed with a relatively narrow, inwardly tapered sectional configuration to minimize the effects of the arms 40 on the spray pattern produced from the nozzle 10. An orifice 44 having a tapered portion 46 extends through the base portion 38 and, in the embodiment herein set forth, a tapered bushing 48 is received in the tapered portion 46 for providing a reduced orifice diameter in the base portion 38. Provided at the apex of the frame 14 where the arms 40 converge is a deflector mounting boss 50 having a deflector mounting shoulder 52. A neck 54 is integral with and extends from the boss 50 for securing the deflector 12 to the frame 14, the neck 54 preferably being initially formed so that it is receivable through a central aperture in the deflector boss 22 and thereafter being spun over during the manufacture of the nozzle 10 to capture the boss 22 between the neck 54 and the shoulder 52, as illustrated in FIGS. 2 and 3. Further, the deflector 12 is secured to the frame 14 so that the side portions 20 extend generally outwardly and toward the base portion 38. Preferably, the deflector 12 is secured to the frame 14 so that it is in a generally transverse relation thereto, i.e., so that the central axis 19 of the deflector 12 is substantially perpendicular to the plane of the arms 40, and preferably the arms 40 are substantially aligned with the slots 24 in the central portions of the opposite longitudinal peripheries of the deflector 12.

The fusible heat sensitive element assembly 16 that is shown is of the type disclosed in the U.S. patent to LOEPSINGER U.S. Pat. No. 2,075,816. Specifically, the fusible assembly 16 comprises a hook 56, a key 58, a strut 60, a heat collector 62, a button 64, and a fusible slug 66. The key 58, which is of a generally spherical configuration, is secured to an end of the hook 56, and the heat collector 62, which is of rounded bell-shaped configuration, is received in the key 58. The slug 66 comprises a material having a preselected melting point, such as a preselected solder composition, and it is interposed between the key 58 and the collector 62 for securing the key 58 and the collector 62 together in a predetermined orientation under normal conditions. A gasket 68 is received over the upper end of the orifice 44, and the button 64 is received on the gasket 68. The upper end of the hook 56 engages the inner periphery of the frame 14 adjacent the point where the arms 40 converge, and one end of the strut 60 engages the hook 58 to maintain the hook 58 in engagement with the frame 14, whereas the opposite end of the strut 60 engages the button 64. The fusible assembly 16 is formed so that when it is installed in the frame 14 in this manner, it is, in effect, spring loaded so that internal stresses in the assembly 16 tend to retain it in an assembled position in the nozzle 10, whereby the button 64 is retained in position over the orifice 44. However, these same stresses tend to urge the key 58 to a reoriented position with respect to the collector 62, although they are normally resisted by the slug 66. However, when a predetermined abnormally high temperature condition is reached so that the slug 66 is melted to a sufficient extent so that the key 58 is no longer secured to the collector 62, the key 58 is reoriented with respect to the collector 62, and this causes the assembly 16 to separate and the parts thereof to be thrown to the side of the frame 14, particularly when liquid is emitted from the orifice 44. Accordingly, the fusible assembly 16 normally maintains the button 64 and gasket 68 in a sealed covering relation over the end of the orifice 44 in the base portion 38 to prevent the discharge of liquid therefrom; but when a predetermined temperature condition is reached, the fusible assembly 16 collapses so that the button 64 and gasket 68 are no longer retained in a covering relation over the orifice 44.

The nozzle 10 can be used in various types of sprinkler systems, and the use thereof both separately and in combination with various types of fusible assemblies, such as the assembly 16 or other types of fusible assemblies, is contemplated. Normally the nozzle 10 is permanently installed in a fire-protection system with the base portion 38 threadedly received in a discharge outlet such as a threaded fitting of the system. Preferably the nozzle 10 is mounted in a substantially vertical disposition so that liquid from the orifice 44 sprays upwardly toward the deflector 12 and is deflected downardly and outwardly, although the installation of the nozzle 10 in a substantially horizontal disposition and in various other dispositions is contemplated. When the nozzle 10 is used in combination with the fusible assembly 16, the assembly 16 normally maintains the button 64 and gasket 68 in covering relation over the discharge end of the orifice 44. However, when a predetermined temperature condition is reached which causes the fusible assembly 16 to separate, the button 64 and gasket 68 are no longer retained in covering relation over the orifice 44 so that liquid can be discharged therefrom. The central apex portions of the frame 14 and the deflector 12 cooperate to deflect liquid which is discharged from the orifice 44 so that it is relatively evenly distributed over a desired coverage area. In this regard, liquid emitted from the orifice 44 is directed towards the central portion of the deflector 12 where it is secured to the frame 14. Accordingly, the liquid impinges on a portion of the deflector mounting boss 50, and the deflector boss 22, with the bosses 50 and 22 cooperating to redirect a portion of the liquid outwardly along the inner surfaces of the deflector 12 so that sufficient quantities of liquid are disbursed throughout the central portion of the elongated spray pattern, and the tines 26, 28, 30, 32, 34 and 36 cooperate with the slots therebetween to help spread the flow uniformly throughout the regions adjacent to the longitudinal peripheries of the relatively narrow spray pattern which is discharged from the nozzle 10. The inwardly bent tines 28 and 34 and the further inwardly bent tines 30 and 32, in combination with the slots 24, tend to break up the flow of liquid as it passes along the inner surfaces of the deflector 12 so that the liquid is randomly sprayed or distributed over the longitudinal peripheries of the coverage area to produce a relatively even liquid distribution.

It is seen, therefore, that the instant invention provides an effective solution to the problem of efficiently distributing a liquid over a relatively long slender object. The configurations of the frame 14 and the deflector 12 cooperate to effectively and substantially evenly distribute a liquid over an elongated, relatively narrow spray area. Accordingly, the nozzle 10 can be effectively used for providing fire protection for relatively long slender objects, and many of the problems relating to overlapping of spray patterns and excessive piping costs of the heretofore-known fire-protection systems which have been used for such objects are effectively eliminated. Accordingly, for these reasons, as well as the other reasons hereinabove set forth, it is seen that the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A liquid discharge nozzle comprising a deflector of generally arch-shaped cross-sectional configuration which is substantially open at opposite ends thereof, said deflector comprising an elongated central portion which extends between said opposite ends and a pair of side portions which extend between said opposite ends and diverge from opposite sides of said central portion to define the side extremities of said deflector, said deflector having a plurality of tines along the side extremities of said side portions but not having tines along the end extremities of said central portion which significantly affect the spray pattern of liquid discharged from said nozzle; and means for mounting said deflector adjacent a liquid discharge outlet so that when liquid is discharged from said outlet, at least a portion of it impinges on the inner surface of said central portion and is deflected outwardly along the inner surfaces of said side portions.

2. In the nozzle of claim 1, said central portion further characterized as extending in an arcuate configuration between said side portions.

3. In the nozzle of claim 2, said side portions extending angularly outwardly and toward said discharge outlet from said central portion.

4. In the nozzle of claim 3, and central portion having a substantially central axis which defines an apex of said deflector, said mounting means further characterized as a frame comprising a base portion securable adjacent said discharge outlet and an arm which extends from said base portion to a point proximal said apex and terminates in a deflector mounting boss, said deflector mounting boss being positioned and configured so that liquid which is discharged from said outlet is at least partially redirected outwardly by said mounting boss, said deflector being secured to said mounting boss.

5. In the nozzle of claim 1, said deflector having a substantially central axis which defines an apex of said deflector, said deflector having a generally elliptically shaped boss formed on the inner side of the central portion thereof, said boss being oriented so that the major axis of the elliptical shape thereof is substantially coextensive with said central axis and so that at least a portion of the liquid from said outlet is directed generally toward said deflector boss and thereby redirected outwardly along the inner surfaces of said deflector.

6. In the nozzle of claim 4, said deflector having a deflector boss formed on the inner side thereof, said deflector boss being disposed adjacent said deflector mounting boss and being oriented so that said mounting boss and said deflector boss cooperate to redirect at least a portion of the liquid from said discharge outlet outwardly along the inner surfaces of said deflector.

7. In the nozzle of claim 3, said central portion having a substantially central axis which defines an apex of said deflector, said mounting means further characterized as a frame comprising a base portion securable adjacent said discharge outlet and a pair of arms which extend from opposite sides of said base portion and converge at a point which is spaced from said body portion, said deflector being secured to said frame adjacent said point where said arms converge, said arms being oriented so that they define a plane which is substantially transverse to said deflector axis.

8. In the nozzle of claim 1, the tines in the central portions of the terminal portions of said side portions being bent inwardly slightly.

9. In the nozzle of claim 7, said tines being defined by slots which extend inwardly from the terminal edges of said side portions generally toward said point where said deflector is secured to said frame.

10. In the nozzle of claim 6, said deflector boss being of generally elliptical configuration and being oriented so that the major axis of the elliptical configuration thereof generally coextends with said deflector central axis.

11. A liquid discharge nozzle comprising a deflector of generally arch-shaped cross-sectional configuration which is substantially open at opposite ends thereof, said deflector comprising an elongated central portion which extends between said opposite ends and a pair of side portions which extend between said opposite ends and diverge from opposite sides of said central portion to define the side extremities of said deflector, said deflector having a plurality of tines along the side extremities thereof; and means for mounting said deflector adjacent a liquid discharge outlet so that when liquid is discharged from said outlet, at least a portion of it impinges on the inner surface of said central portion and is deflected outwardly along the inner surfaces of said side portions, said deflector having a substantially central axis which defines an apex thereof and having a generally elliptically shaped deflector boss formed on the inner side of the central portion thereof, the major axis of the elliptical shape of said deflector boss being substantially greater than the minor axis thereof, said deflector boss being oriented so that said major axis is substantially coextensive with said central axis and so that at least a portion of the liquid from said outlet is directed generally toward said deflector boss and thereby redirected outwardly along the inner surfaces of said deflector.

12. A liquid discharge nozzle comprising a deflector of generally arch-shaped configuration which is substantially open at opposite ends thereof, said deflector comprising an elongated central portion which extends between said opposite ends and has a substantially central axis which defines an apex of said deflector, and a pair of side portions which diverge from opposite sides of said central portion to define the side extremities of said deflector, said deflector having a plurality of tines along the side extremities thereof and having a substantially centrally disposed deflector boss formed on the inner side thereof, and means mounting said deflector adjacent a liquid discharge outlet, said mounting means comprising a frame having a base portion securable adjacent said discharge outlet and an arm which extends from said base portion to a point proximal said apex and terminates in a deflector mounting boss, said mounting means securing said deflector so that said deflector boss is disposed adjacent said deflector mounting boss, said deflector mounting boss being formed so that the sides thereof extend outwardly and toward said deflector boss from the central portion of said deflector mounting boss which is closest to said discharge outlet, said deflector boss and said deflector mounting boss being oriented so that they cooperate to redirect at least a portion of the liquid from said discharge outlet outwardly along the inner surfaces of said deflector.

* * * * *